United States Patent [19]

Luchaco

[11] 4,195,599

[45] Apr. 1, 1980

[54] SPEED SENSITIVE ELECTRONIC FUEL CONTROL SYSTEM FOR AN INTERNAL COMBUSTION ENGINE

[75] Inventor: David G. Luchaco, Macungie, Pa.

[73] Assignee: The Bendix Corporation, Southfield, Mich.

[21] Appl. No.: 790,625

[22] Filed: Apr. 25, 1977

[51] Int. Cl.[2] ..... F02B 3/04

[52] U.S. Cl. ..... 123/32 EA; 123/117 R

[58] Field of Search ..... 123/32 EA, 32 EB, 117 R

[56] References Cited

U.S. PATENT DOCUMENTS

| | | | |
|---|---|---|---|
| 3,543,734 | 12/1970 | Mair | 123/32 EA |
| 3,659,571 | 5/1972 | Lang | 123/102 |
| 3,727,081 | 4/1973 | Davis et al. | 123/32 EA |
| 3,734,068 | 5/1973 | Reddy | 123/32 EA |
| 3,744,460 | 7/1973 | Monpetit | 123/32 EA |
| 3,835,821 | 9/1974 | Hill et al. | 123/32 EB |
| 3,854,458 | 12/1974 | Reddy | 123/32 EA |
| 3,858,561 | 1/1975 | Aono | 123/32 EA |
| 3,904,856 | 9/1975 | Monpetit | 123/32 EB |
| 3,913,536 | 10/1975 | Lapple et al. | 123/32 EA |
| 3,938,479 | 2/1976 | Oberstadt | 123/32 EA |
| 3,971,354 | 7/1973 | Luchaco et al. | 123/32 EA |
| 4,002,152 | 1/1977 | Hoshi | 123/32 EB |
| 4,040,395 | 8/1977 | Demetrescuo | 123/32 EA |
| 4,092,955 | 6/1978 | Reddy | 123/32 EA |

FOREIGN PATENT DOCUMENTS

| | | | |
|---|---|---|---|
| 2313013 | 11/1973 | Fed. Rep. of Germany | 123/32 EA |

*Primary Examiner*—Verlin R. Pendegrass
*Assistant Examiner*—S. A. Cangialosi
*Attorney, Agent, or Firm*—James R. Ignatowski; William F. Thornton

[57] ABSTRACT

The invention is an electronic fuel control system for an internal combustion engine having a first capacitance which is charged to a value indicative of the engine's speed during a first rotational interval of the engine. At the end of the rotational interval the charge on the first capacitance is transferred to a second capacitance which is further charged at a predetermined rate during a second rotational interval. A comparator compares the value of the charge on the second capacitance with a signal indicative of the engine's load. The comparator generates a pulse width signal indicative of the engine's fuel requirements during the interval the charge on the second capacitance is less than the value of the load signal.

24 Claims, 6 Drawing Figures

SPEED SENSITIVE ELECTRONIC FUEL CONTROL SYSTEM FOR AN INTERNAL COMBUSTION ENGINE

BACKGROUND OF INVENTION

1. Field of Invention

The invention is related to electronic fuel control systems for internal combustion engines and in particular to speed sensitive electronic fuel control systems of the type taught by Reddy in U.S. Pat. No. 3,734,068.

2. Prior Art

The speed sensitive electronic fuel control disclosed by Reddy in U.S. Pat. No. 3,734,068 is illustrated in FIG. 1. This system embodies two capacitances 10 and 12 which are sequentially charged from two current sources respectfully designated RPM Signal Generator 14 and Ramp signal Generator 16. Electronically actuated switches, illustrated by mechanical ganged switch 18, controlled by an output signal from Switch Circuit 20, connects the two signal generators 14 and 16 to capacitances 10 and 12 in a manner so that when capacitance 10 is being charged by the RPM Signal Generator 14, capacitance 12 is being charged by Ramp Signal Generator 16 and vice versa. In this manner, both capacitances are sequentially charged, first by the output of the RPM Signal Generator 14, then by the output of the Ramp Signal Generator 16. At the end of each sequential charging period, the capacitance having been last charged by the output from the Ramp Signal Generator is discharged by means of a Discharge Circuit 22 to a predetermined value prior to the initiation of a new charging sequence.

The Switch Circuit may be a simple bi-stable flip-flop producing a square wave output signal in response to trigger signals designated TR 1 and TR 2. These trigger signals may be derived from the engine's crank shaft, flywheel or ignition system, and are indicative of predetermined angular positions of the engine, normally 180° apart. Switch 18 responds to this square wave signal and assumes a first position in response to the positive portion and a second position in response to the ground or negative portion of the signal. Discharge Circuit 22 responds to the positive and negative transitions of the square wave and discharges the appropriate capacitance. The potential developed across both capacitances as they are being charged are communicated to the negative input of Comparator 24 by means of diodes 26 and 28. The output of a Load Signal Generator 30 is applied to the positive input to the Comparator 24. The Load Signal Generator 30 may be a pressure sensor generating a signal indicative of the pressure in the engine's air intake manifold as taught by Reddy in U.S. Pat. No. 3,734,068 or any other sensor generating a signal indicative of the engine's load.

The output of the comparator 24 is connected to the inputs of two parallel AND gates 32 and 34. The square wave output of the Switch Circuit 20 is applied directly to the alternate input of AND Gate 32 and indirectly to the alternate input of AND Gate 34 by means of an Inverting Amplifier 36. Alternately, the reciprocal or complementary square wave signal generated by the flip-flop may be applied directly to AND Gate 34.

The operation of this prior art circuit is described with reference to FIG. 1 and the waveforms shown on FIGS. 2A and 2B. It is assumed the Switch Circuit 20 is triggered by trigger signal TR 1 and its initial output signal is positive as shown on FIG. 2A. The positive output signal from the Switch Circuit 20 actuates switch 18 to the position shown on FIG. 1, activates Discharge Circuit 22 to discharge capacitance 12 to the predetermined value and enables AND Gate 32. Gates 32 or 34 to either Fuel Injector Group 1 or Group 2 depending upon which of the two AND gates is enabled by the square wave signal generated by the Switch Circuit 20.

The wave forms shown on FIG. 2B illustrate the change in the output 46 from the Comparator 24 when the engine speed has increased accompanied by an increase in the value of the load signal 44. The positive portion of the signal 46 is increased by two factors. Increasing the value of the load signal increases the positive portion of the Comparator's output by a first factor designated by the cross hatched area designated "a" indicative of the increased time it takes for the potential across capacitances 10 or 12 to reach the higher value of the load signal 44. The positive portion of the output signal generated by the Comparator 24 may also increased by a second factor, designated by the cross hatched section since the final value of the charge capacitances 10 or 12 is lower when switch 18 changes state in response to the square wave signal generated by the Switch Circuit 20. Obviously, if the only change in the waveforms illustrated on FIG. 2B was an increase in engine speed without a corresponding change in the load signal, the positive portion of the output signal from Comparator 24 would increase or decrease by the factor indicative of the time it would take the Ramp Signal Generator 16 to charge capacitances 10 or 12 to the value shown on Waveform 2A. Conversely, if the only change was an increase in the load signal without a corresponding change in the engine speed, the increase in the positive portion of the output from Comparator 24 would only proportional to the difference in time it would take the Ramp Signal Generator to charge either capacitance to the new value of the load signal.

Although this circuit works extremely well, it requires that the two capacitances 10 and 12 be a matched pair (identical) which require that they be tested prior to assembly to assure that the output signals generated by the Caparator 24 will be identical within permitted tolerances. Further, since both capacitances are charged by both the RPM and Ramp Generators, a severe restraint is placed on both signal generators to produce the desired wave forms. The disclosed invention eliminates both of these deficiencies.

SUMMARY

The invention is an improved fuel control system of the type taught by Reddy in U.S. Pat. No. 3,734,068 in which the signal generated by a first signal generator charges a first capacitance to a value indicative of engine speed during a first predetermined interval of the engine's angular rotation. A charge transfer circuit, at the end of the first predetermined interval, transfers the charge on the first capacitance to the second capacitance from its initial value indicative of the engine's speed to a value equal to the value of the load signal.

The object of the invention is a speed sensitive electronic fuel control system in which the charge on the first capacitance indicative of the engine's speed is transferred to a second capacitance which is subsequentialy charged at a predetermined rate to the value of the load signal.

Another object of the invention is a fuel control circuit in which the two capacitances do not have to be a matched pair.

Another object of the invention is a fuel control system in which the value of the two capacitances do not have to be equal.

A final object of the invention is a fuel control system in which the output signal generated by the two signal sources are not constrained by the requirement that both capacitances have the same value.

These and other objects will become apparent from a reading of the Detailed Description of a Preferred Embodiment in conjunction with the drawings.

DETAILED DESCRIPTION OF THE INVENTION

Figure 1:
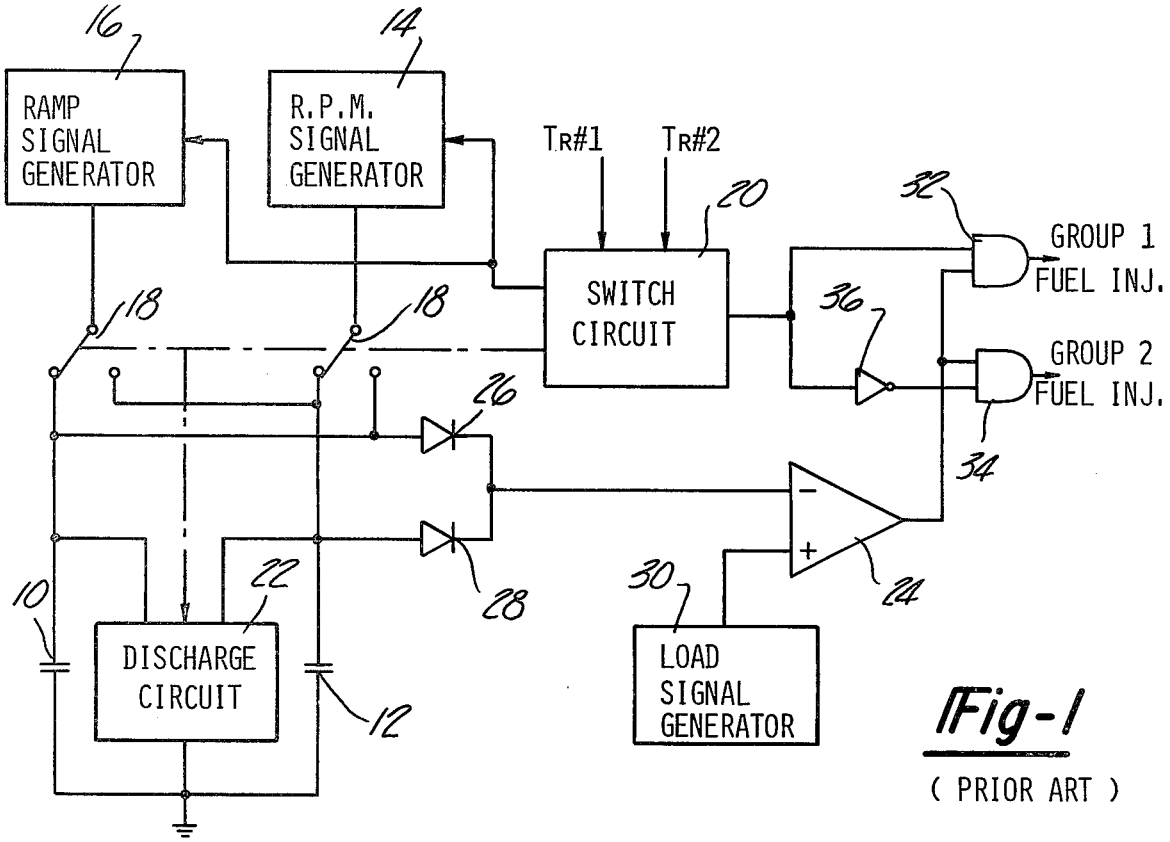
Fig-1 ( PRIOR ART )
FIG. 1 is a block diagram of the prior art fuel control system as taught by Reddy in U.S. Pat. No. 3,734,068.
Figure 3:
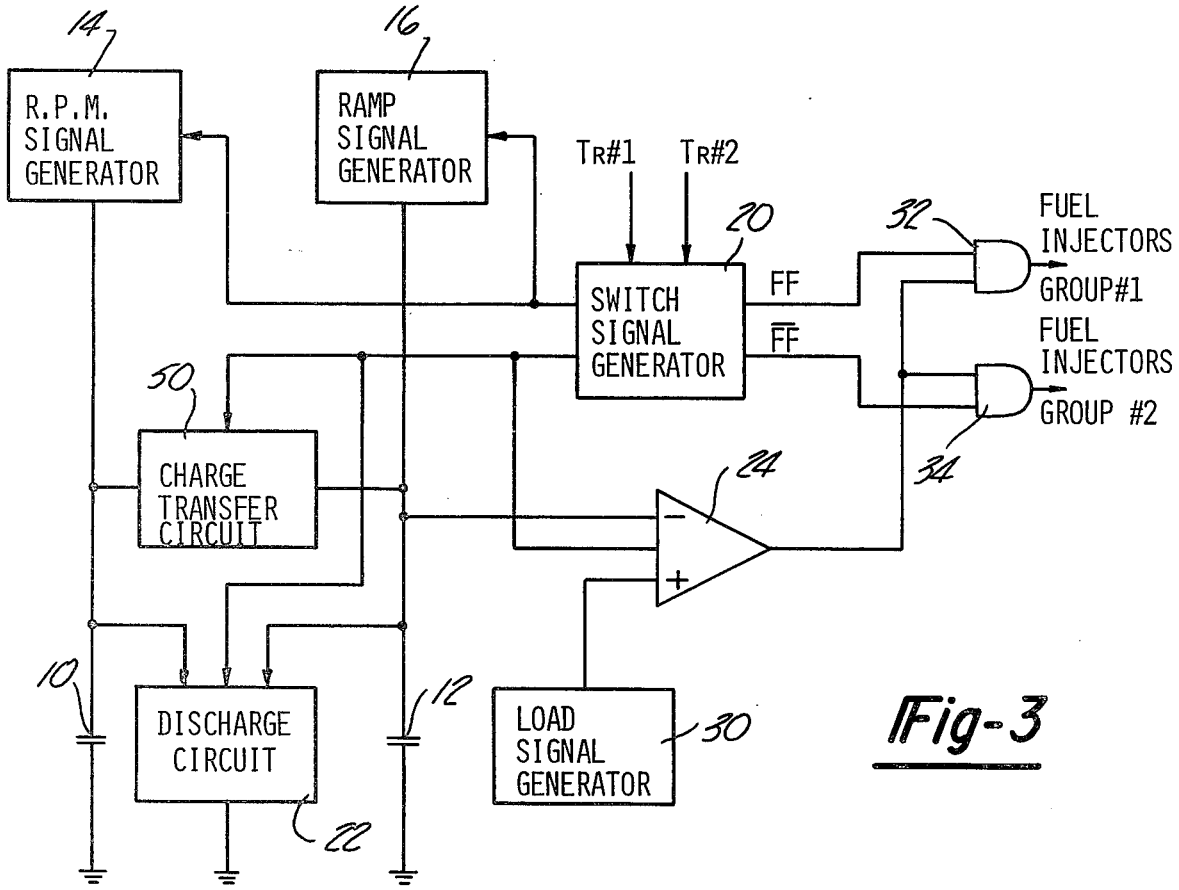
FIG. 3 is a block diagram of the preferred embodiment of the disclosed system.

Referring to FIG. 3, there is shown a block diagram of the improved fuel control system of the type disclosed by Reddy in U.S. Pat. No. 3,734,068. For continuity purposes, common elements between this improved fuel control system and those of the prior art discussed with reference to FIG. 1 have the same identifying indicia. A comparable RPM Signal Generator 14 generates a reference signal which charges a first capacitance 10 to a potential having a value indicative of the engine's speed. As discussed with reference to FIG. 1, the RPM signal may be single valued as taught by Reddy in U.S. Pat. No. 3,734,068 or may vary as a function of time as taught in a commonly assigned copending patent application. A transfer circuit 50 is connected between the first capacitance 10 and a second capacitance 12 and transfers the potential stored on capacitance 10 to capacitance 12 in response to a transfer signal generated by a Switch Signal Generator 20 Capacitance 12 is further charged by a ramp signal generated by a Ramp Signal Generator 16. The ramp signal may be single valued as taught by Reddy in U.S. Pat. No. 3,734,068 or may vary as a function of time as shall be discussed hereinafter. A discharge Circuit 22 respectfully discharges capacitance 10 to a predetermined value determined by the Ramp Signal Generator 16 in response to signals generated by the Switch Signal Generator 20. The potential generated across capacitance 12 is communicated to the negative input of a Comparator 24 which also receives a load signal at its positive input from a Load Signal Generator 30. The Load Signal Generator 30 may be a pressure sensor generating a signal indicative of the pressure in the engine's air intake manifold or any other type of sensor generating a signal indicative of the engine's load as is known in the art. The Comparator may also receive an inhibit signal (not shown) from the Switch Signal Generator to disable the Comparator during the transfer process between the two capacitances. The output of the Comparator 24 is connected to the inputs of AND Gates 32 and 34. The alternate inputs of the AND Gates 32 and 34 receive complimentary flip-flop signals designated FF and $\overline{FF}$ from the Switch Signal Generator 20 which enable AND Gates 32 and 34 in an alternating sequence. The Switch Signal Generator 20 receives trigger signals TR #1 and TR #2 generated by a trigger signal generator (not shown). The trigger signals TR #1 and TR #2 are generated as a function of the angular rotational position of the engine's crankshaft, and are normally 180° apart. These signals may be derived from sensors detecting the rotational position of the crankshaft itself such a cam actuated reed switches, or may be magnetic pick up detecting the position of the crank shaft or flywheel. Alternately the trigger signals may be generated by an inductive pick-up detecting the ignition signals or any other means known in the art.

Figure 4:
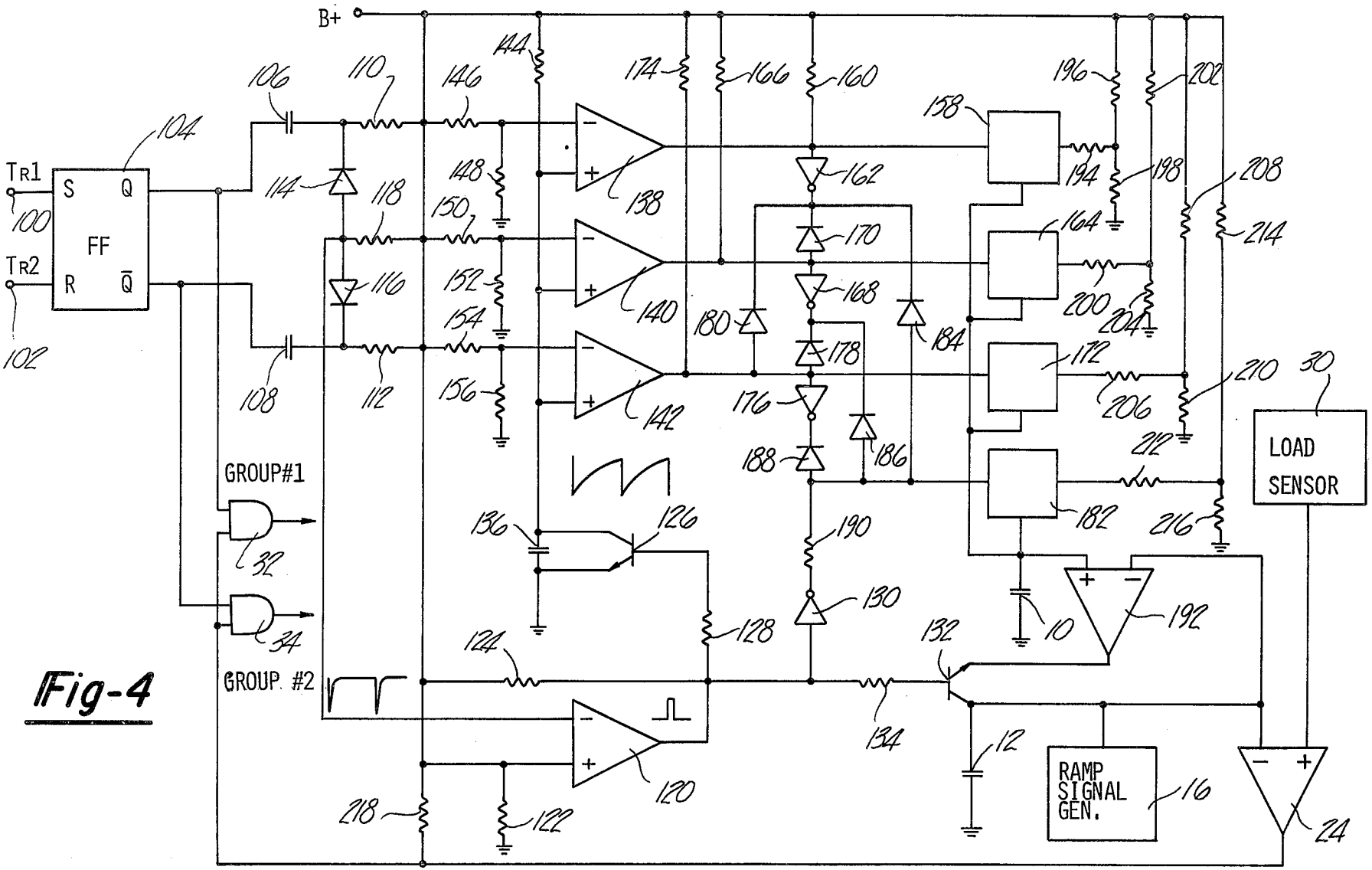
FIG. 4 is a circuit diagram of a preferred embodiment of the fuel control system shown on FIG. 3.

FIG. 4 is a circuit diagram of the fuel control system shown in block form on FIG. 3. The terms B+ and ground as used herein have their usual meaning and represent the positive and negative inputs of a source of electrical energy normally associated with an internal combustion engine. This source may be a battery or any other engine driven source such as an alternator or generator. The trigger signals TR #1 and TR #2 are received at input terminals 100 and 102 respectively which are connected to the set and reset inputs of an RS flip-flop 104. The outputs Q and $\overline{Q}$, a flip-flop 104 are connected to one of the inputs of AND Gates 32 and 34 respectively. The Q and $\overline{Q}$ signals are the FF and $\overline{FF}$ signals described with reference to FIG. 3. The Q and the $\overline{Q}$ outputs of flip-flop 104 are connected to one electrode of capacitances 106 and 108 respectively. The opposite electrodes of capacitances 106 and 108 are connected to B+ through resistances 110 and 112 respectively and to the cathodes of diodes 114 and 116. The anodes of diodes 114 and 116 are connected together and to B+ through a resistance 118 and to the input termed input of a comparator 120. The positive input of comparator 120 is connected to B+ and to ground through a resistance 122. The output of the comparator 120 is connected to B+ through a resistance 124 and to the base of a transistor 130 through a resistance 132. The 108 respectively. The opposite electrodes of capacitances 106 and 108 are connected to B+ through resistances 110 and 112 respectively and to the cathodes of diodes 114 and 116. The anodes of diodes 114 and 116 are connected together and to B+ through a resistance 118 and to the input termed input of a comparator 120. The positive input of comparator 120 is connected to B+ and to ground through a resistance 122. The output of the comparator 120 is connected to B+ through a resistance 124 and to the base of a transistor 130 through a resistance 132. The output of comparator 120 is also connected to the input of an inverting amplifier 130 and to the base of a transistor 132 through a resistance 134. Returning now to transistor 126, the emitter is connected to ground and to one electrode of a capacitance 136. The emitter of transistor 126 is connected to the positive inputs of comparators 138, 140 and 142 to B+ through resistance 144, and to the opposite electrode of capacitance 136.

The negative input of comparator 130 is connected to the center tap of a voltage dividing resistance network between B+ and ground consisting of resistances 146 and 148. In a like manner, negative input to comparator 140 is connected to the center tap of a voltage dividing network between B+ and ground consisting of resistances 150 and 152. Also, the negative input of comparator 142 is connected to a center tap of a voltage divider network between B+ and ground consisting of resistances 154 and 156.

The output of comparator 138 is connected to the control input of a bi-lateral switch 158 such as RCA-CD4106 or RCA-CD4066 manufactured by Radio Corporation of America, to B+ through a resistance 160 and to the input of an inverting amplifier 160. The output comparator 140 is connected to the control input of a bi-lateral switch 164, to B+ through a resistance 166, to the input of an inverting amplifier 168 and to the anode of a diode 170. The output of comparator 142 is connected to the control input of a bi-lateral switch 172 to B+ through a resistance 174, to the input of an inverting amplifier 176 and to the anode of diode 178. The output of inverting amplifier 162 is connected to the cathode of diode 170 and to the input of comparator 142 through diode 180 and to the control input of a bi-lateral switch 182 through a diode 184. The output of inverting amplifier 168 is connected to the cathode of diode 178 and to the control input of the bi-lateral switch 182 through a diode 186. The output of inverting amplifier 176 is also connected to the control input of the bi-lateral switch 182 through a diode 188 and to the output of inverting amplifier 130 through a resistance 190.

The outputs of the bi-lateral switches 158, 164, 172, and 182 are connected together and to the ungrounded electrode of a capacitances 10 and to the positive input of a comparator 192. The other electrode of capacitance 10 is connected directly to ground. The output of comparator 192 is connected to the emitter of transistor 132. The collector of transistor 132 is connected to the ungrounded electrode of capacitance 12, the negative input of comparator 192, the negative input of comparator 24 as shown on FIG. 3 and to output of the Ramp Signal Generator 16. The Ramp Signal Generator 16 may be a single current source as disclosed by Reddy in U.S. Pat. No. 3,734,068 or a multiple current source as taught herein with reference to the RPM Signal Generator. Because of the similarities of these circuits, the details of the Ramp Signal Generator need not be shown in detail for an understanding of the invention. The positive input of comparator 24 is connected to the Load Sensor 30 as shown on FIG. 3. The input to the bi-lateral switch 158 is connected by means of a resistance 194 to the center tap of a voltage divider resistance network consisting of resistances 196 and 198. The input of the bi-lateral switch 164 is connected by means of a resistance 200 to the center tap of a voltage dividing network consisting of resistances 202 and 204. The input to bi-lateral switch 172 is connected through resistance 206 to the center tap of a voltage divider network comprising resistance 208 and 210 connected between B+ and ground. The input to bi-lateral switch 182 is connected through resistance 212 to the center tap of a voltage divider network between B+ and ground comprising resistances 214 and 216. The output of comparator 24 is connected directly to the alternate inputs of AND Gates 32 and 34 as shown on FIG. 3 and to B+ through resistance 218.

Figure 5:
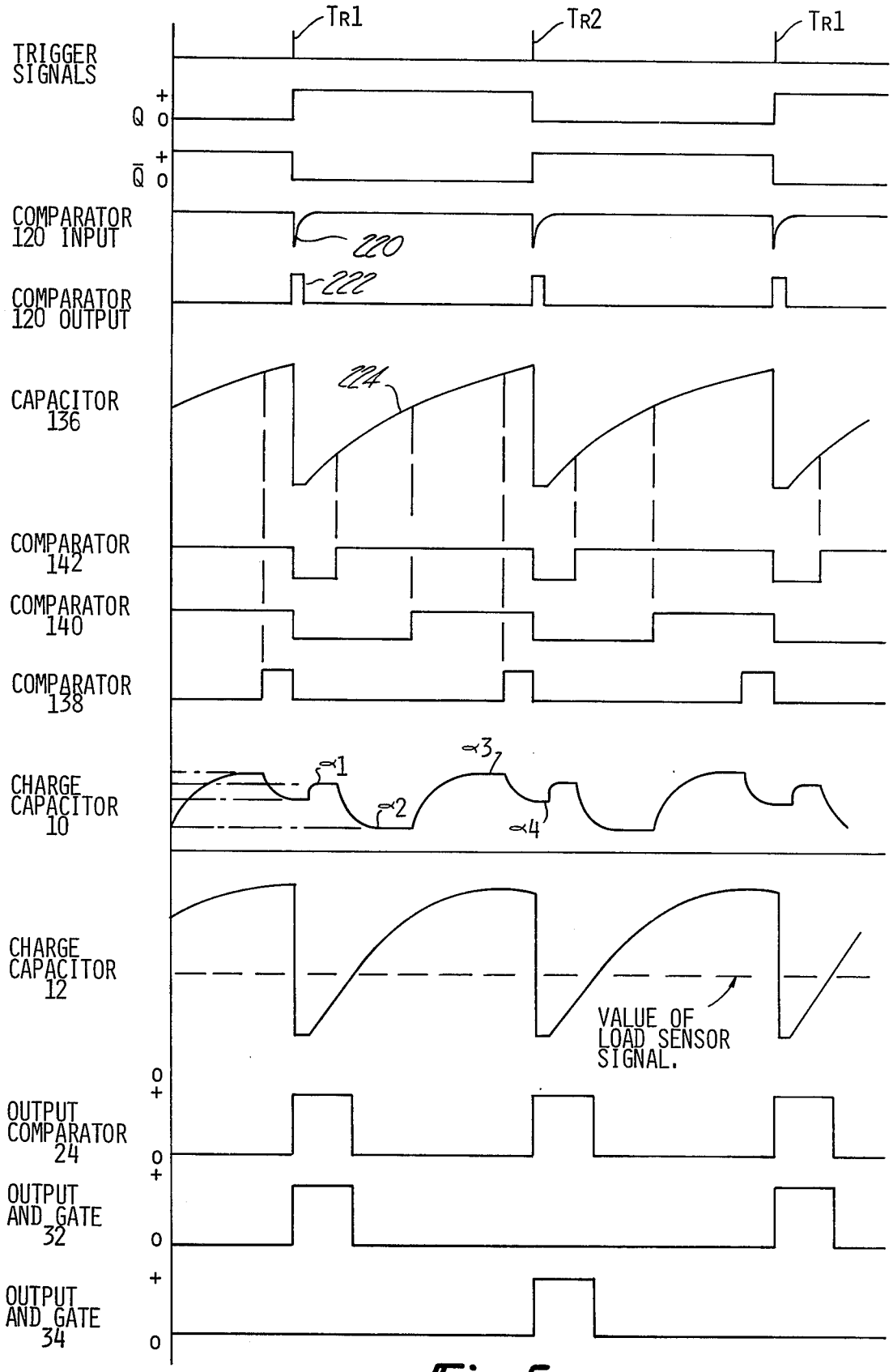
FIG. 5 is a series of waveforms used in explaining the operation of the circuit shown on FIG. 2A.

The operation of the circuit will be described with reference to FIG. 4 and the waveforms shown on FIG. 5. Referring to FIG. 4, the trigger signals TR 1 and TR 2 are received by the flip-flop 104 which generates complimentary square waves at its Q and $\overline{Q}$ output as indicated on the waveforms of FIG. 5. The trailing edges of the square waves generated at the Q and Q outputs of flip-flop 104 produce a short negative going pulse 220 as shown on FIG. 5 at the junction between diodes 114 and 116 which is communicated to the negative input of comparator 120. The comparator 120 responds to these negative pulses generates a relatively short positive pulse signal 222 at its output which forward biases transistor 126 to discharge capacitance 136. The positive pulse output from comparator 120 is also communicated to the base of transistor 132 which disengages capacitance 12 to the potential on capacitance 10 as shall be explained hereinafter. After the termination of the pulse from comparator 120, capacitance 136 start to charge through resistance 144 and generates a ramp signal 224 which is applied to the positive inputs of comparators 138, 140 and 142. Termination of the positive pulse 222 also generates a positive signal at the output of inverter amplifier 130 which enables bi-lateral switch 182 which charges capacitance 10 to the value $\alpha_1$ determined by the voltage divider network consisting of resistances 214 and 216. Resistance 212 determines the rate at which capacitance 10 is charged by this voltage divider network.

After a short period of time, the charge on capacitance 136 exceed the value of the potential applied to the negative input of comparator 142 as determined by the voltage divider network consisting of resistances 154 and 156. When the charge on capacitance 136 exceed this value, comparator 142 produces a positive output signal which activates bi-lateral switch 172. The positive output of comparator 142 also produces a negative or ground signal at the output of inverter amplifier 176 which turns off bi-lateral switch 182 through diode 188. Capacitance 10 is then charged to a value $\alpha_2$ as determined by the voltage divider network consisting of resistances 208, and 210. The charge on the capacitor will either decrease as shown on FIG. 5, or increase depending on the value of the potential determined by the voltage divider network. After second time interval, the charge on capacitance 136 exceeds the potential of voltage divider comprising resistances 150 and 152 and comparator 140 produces a positive output enabling bi-lateral switch 164. The positive output of comparator 140 will also produce a negative signal at the output of inverter amplifier 168 which will be communicated to the input of bi-lateral switches 172 and 182 through diodes 186 and 188 respectively, thereby deactivating both of these bi-lateral switches. The potential generated at the center tap of the voltage divider network consisting of resistances 202 and 204 will then be communicated to capacitance 10 which will either charge or discharge to the potential $\alpha_3$ established by the voltage divider network. After a third period of time, the charge across capacitance 136 will exceed the potential generated by the voltage divider network consisting of resistances 146 and 148 and comparator 138 will generate a positive output signal communicated to bi-lateral switch 158. Positive output of comparator 144 will also produce a negative or ground signal at the output of inverter amplifier 162 which will effectively deactivate electronic switches 164, 172 and 178 through diodes 170, 180 and 184. Capacitance 10 will then be either charged or discharged to a potential $\alpha_4$ indicative of the potential generated by the voltage divider network consisting of resistances 196 and 198.

Referring now to the charge transfer portion of the circuit, capacitance 12 is charged by the signal from the Ramp Signal Generator 16 to a value well above the charge on capacitants 10 which is communicated to the negative input of comparator 192. Comparator 192 also receives the charge on capacitance 10 at its positive input. Since the charge on capacitance 12 is greater than the charge on capacitance 10, comparator 192 has a negative or ground output.

Figures 2A, 2B:
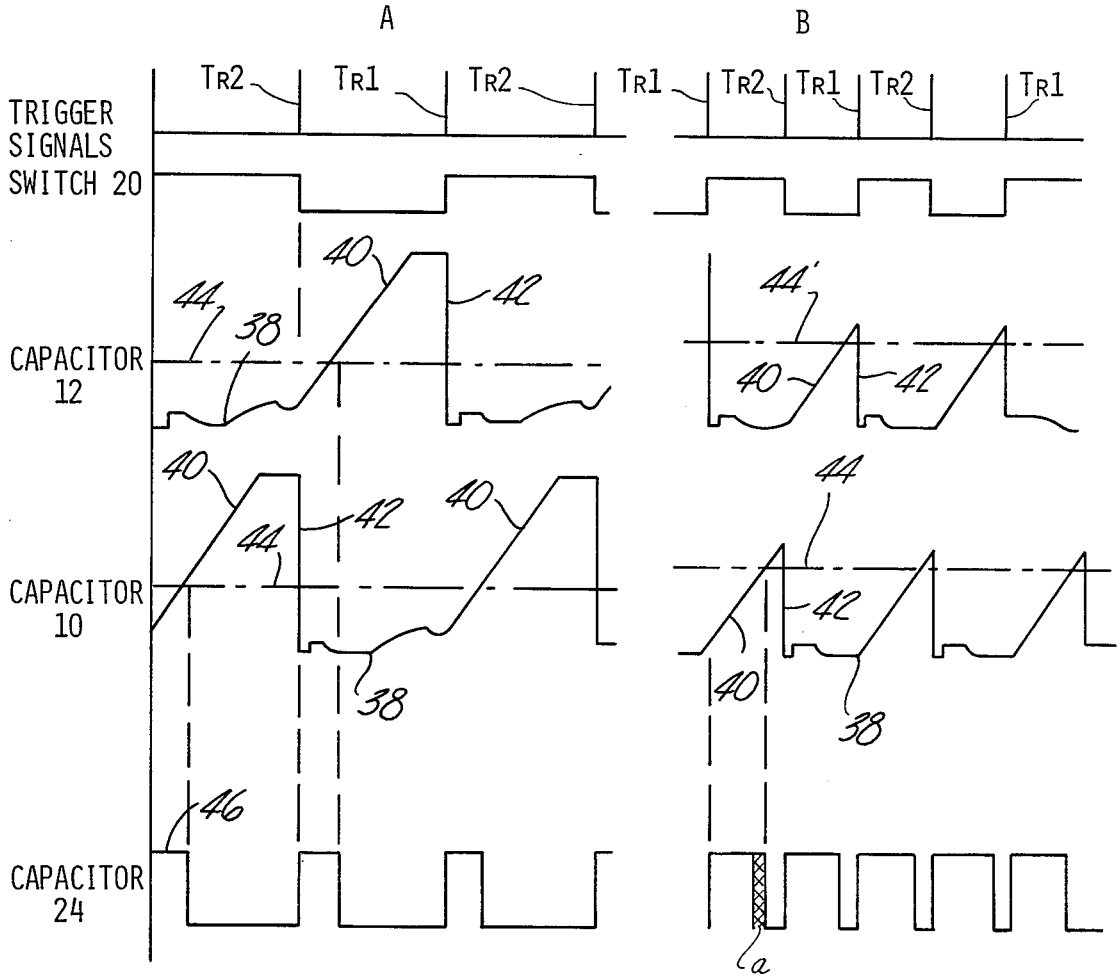
FIG. 2A is a series of waveforms used to discuss the operation of the system illustrated in FIG. 1 at a low engine speed.
FIG. 2B is a series of waveforms used to discuss the operation of the system illustrated in FIG. 1 at a higher engine speed.

The positive pulse 222 generated by comparator 120 forward biases transistor 132 making it conductive. Capacitance 12 is then discharged through transistor 132 to the grounded output of comparator 192 until its value is equal to the value of the charge on capacitance 10. When the potentials on capacitances 10 and 12 are equal, the output of comparator 198 goes positive terminating the discharge of capacitance 12 and therefore capacitance 12 has a potential equal to the potential on capacitance 10. The termination of the positive output of comparator 120 back biases transistor 136 and capacitance 12 is charged by the output signal from the Ramp Signal Generator 16 increasing potential across capacitance 12 to a value greater than that transferred from capacitance 10. The rate at which capacitance 12 is charged by the Ramp Signal Generator 16 may be exponential as shown in FIG. 5, linear as shown in FIG. 2A or segmented.

As previously described with reference to FIG. 3, the output of the Load Sensor 30 is communicated to the positive input of comparator 24. As long as the charge on capacitance 12 is less than the value of the load sensor signal, the output of comparator 24 is a positive signal which is communicated to the alternate inputs of AND Gates 32 and 34. As previously indicated, AND Gates 32 and 34 are alternately enabled by the Q and $\overline{Q}$ outputs of flip-flop 104 and therefore alternately pass the positive output signal generated by the comparator 24. The output of comparator 24 transmitted through AND Gates 32 and 34 is a pulse width modulated injection signal indicative of the fuel requirements of the engine.

Having described the disclosed fuel control system with regards to a specific embodiment, it is not intended that the invention be limited to the embodiment discussed in the specification and illustrated in the drawings. It is recognized that a person skilled in the art could devise circuits to perform the same functions in the same way without departing from the spirit of the invention.

What is claimed is:

1. A control system for producing an output signal indicative of the combination of two independent variables comprising:

first means for cyclically generating and storing a first signal having a value indicative of the value of a first independent variable;

storage means for storing a second signal;

transfer means for transferring said first signal to said storage means at the end of each cycle so that the initial value of said second signal at the beginning of each cycle is the value of said first signal at the end of the preceding cycle;

second means for generating a third signal increasing the value of said second signal stored in said storage means at a predetermined rate;

means for generating a fourth signal having a value indicative of the value of the second independent variable; and means for comparing the value of said second signal with said fourth signal to generate an output signal having a pulse width indicative of the time it takes from the beginning of each cycle for the value of said second signal to equal the value of the fourth signal.

2. The control system of claim 1 wherein the output signals are indicative of a control parameter of a rotary device and wherein one of the independent variables is the rotary speed of said rotary device, said first means comprising:

means for generating trigger signals at predetermined rotational interval of said rotary device;

at least one signal source for generating a fifth signal having a predetermined value;

storage means for storing said fifth signal between the occurrence of said trigger signals wherein the stored value of said fifth signal is said first signal and the cyclic operation of said first means is determined by rate at which said trigger signals are generated; and wherein said transfer means transfer said first signal to said storage means in response to said trigger signals.

3. The control system of claim 2 wherein said control parameter is a nonlinear function of the device's rotary speed, said at least one signal source is a plurality of signal sources, wherein each of said plurality of signal sources generates signals having a value different from said predetermined value; and further includes switch signal generator means for generating switch signals at predetermined intervals after the occurrence of a trigger signal, said switch signals operative to enable, one at a time, in a predetermined sequence each of said plurality of signal sources wherein said first signal has a value equal to the sum of the signals sequentially generated by said plurality of signal sources and stored by said storage means.

4. The control system of claim 3 wherein said rotary device is an internal combustion engine having a sensor generating a load signal indicative of the engine's load and at least one fuel injector valve delivering fuel to the engine in response to the output signal, wherein said means for generating trigger signals is a sensor detecting predetermined rotational position of said engine; and said means for comparing, compares the absolute value of said second signal with the load signal.

5. The control ystem of claim 4 wherein said at least one fuel injector valve is two groups of injector valves, wherein each group has at least one injector valve;

said means for generating trigger signals generates trigger signals for two rotational positions of the engine 180° apart, and where said system further includes:

means for generating sequence signals distinguishing the rotational intervals between said two rotational positions; and gate means, enabled by said sequence signals for transmitting said output signal to each of said groups of fuel injector valves in an alternating sequence.

6. In combination with an internal combustion engine having means for generating trigger signals indicative of at least two diametrically opposite angular positions of the engine's crankshaft, a sensor generating a load signal having a valve indicative of the engine's load, and at least one electrically actuated fuel injector valve for delivering fuel to the engine in response to an injection signal, an electronic fuel control system comprising:

transfer signal generator means for generating transfer signals in a timed sequence with the trigger signals;

RPM signal generator means for generating an RPM signal;

first storage means receiving said RPM signal for storing a first sum signal having a value indicative of the integrated sum of said RPM signal between successive transfer signals;

second storage means;

transfer means for transferring said first sum signal to said second storage means in response to each transfer signal;

ramp signal generator means for generating a ramp signal increasing the value of said first sum signal transferred to and stored in said second storage means at a predetermined rate to generate a second sum signal having a value indicative of the sum of said first sum signal and the integrated value of said ramp signal; and comparator means responsive to a difference between the value of said second sum signal and the value of said load signal for generating an injection signal, said injection signal having a pulse width indicative of the time it takes for the value of said second sum signal to equal the value of said load signal.

7. The combination of claim 6 wherein the load sensor is a pressure sensor generating a load signal having a value indicative of the pressure in the engine's air intake manifold.

8. The combination of claim 6 wherein said engine has at least two groups of fuel injector valves;

said transfer signal generator means further includes means for generating sequence signals alternating in value in timed relationship with said trigger signals; and said fuel control system further includes gate means enabled by said sequence signals for transmitting said injector signals to said two groups of injector valves, one group at a time, in an alternating sequence.

9. The combination of claim 8 wherein:

said means for generating sequence signals is a bi-stable flip-flop circuit, switching from one stable state to the other in response to said trigger signals, and said sequence signals are the two complimentary output signals of said bi-stable flip-flop circuit; and, said gate means is two AND gates, one of said AND gates receiving said injection signals and enabled by one of said two complimentary output signals, and the other AND gate receiving said injection signals and enabled by the other of said complimentary output signals.

10. The combination of claim 6 wherein:

said first and second storage means are first and second capacitances respectively;

said RPM signal generator is at least one RPM current source operative to charge said first capacitance to a predetermined potential value in the time interval between said transfer signals, and said first sum signal is the potential value of the charge stored by said first capacitance; and wherein:

said ramp signal generator means is at least one current source operative to charge said second capacitance to a potential value significantly higher than said predetermined potential value; and wherein:

said transfer means is a charge transfer circuit transferring the potential value of the charge stored on said first capacitance to said second capacitance in response to said transfer signal.

11. The combination of claim 10 wherein said charge transfer circuit comprises:

a charge comparator receiving the potential value of the charge stored by said first capacitance at a positive input and the potential value of the charge stored by the second capacitance at a negative input, said comparator operative to produce a low signal at an output when the potential value applied to the negative input is greater than the potential value applied to the positive input, and a high output signal when the potential values of the signals applied to the positive and negative inputs are reversed; and, a transistor having a collector receiving the potential value of the charge stored on said second capacitance, an emitter connected to the output of said charge comparator, and a base receiving said transfer signal, said transistor operative to provide unidirectional low impedance path from said second capacitance to the output of said charge comparator.

12. The combination of claim 10 wherein said at least one RPM current source is a plurality of current sources, said combination further includes switch signal generator means for sequentially generating switch signals at predetermined intervals after the occurrence of each trigger signal, said sequentially generated switch signal operative to sequentially energize said plurality of current sources, one at a time, to charge and discharge said first capacitance during said predetermined intervals to generate a first sum signal having a value variable as a function of time.

13. The combination of claim 12 wherein said at least one ramp current source is at least two current sources sequential energized by said at least one of said switch signals to charge said second capacitance at a rate variable as a function of time.

14. A method for generating injection signals controlling the quantity of fuel being delivered to an internal combustion engine having a crankshaft comprising:

detecting the rotational position of the crankshaft to generate trigger signals indicative of two diametrically opposite rotational positions of the crankshaft;

generating transfer signals in a timed sequence with said trigger signals;

generating a speed reference signal;

storing in a first storage means said speed reference signal to generate a first sum signal having a value indicative of the integrated value of said speed reference signal between successive transfer signals;

transferring said first sum signal to a second storage means in response to each transfer signal;

generating a ramp signal;

summing in said second storage means the integrated value of said ramp signal with said first sum signal to generate a second sum signal having a value increasing with time;

generating a load signal indicative of the load on the engine;

comparing the load signal with said second sum signal to generate an injection signal having a pulse width indicative of the time required after the occurrence of each transfer signal for said second sum signal to equal the value of said load signal; and applying said injection signal to at least one fuel delivery device to deliver a quantity of fuel to the engine proportional to the pulse width of said injection signal.

15. The method of claim 14 wherein said first and second storage means are a first and second capacitor respectively, said step of generating a speed reference signal generates at least a first current signal controlling the charging of said first capacitor and the value of said first sum signal is the value of the charge stored on said first capacitor, said step of generating a ramp signal generates a second charging current increasing the charge stored in the second capacitor from the value of the transferred first sum signal to a substantially higher value and the value of the charge on said second capacitor is said second sum signal, and said step of transferring includes the step of transferring the charge on said first capacitor to said second capacitor in response to each transfer signal.

16. The method of claim 14 wherein said step of generating a load signal includes the step of detecting the pressure in the engine's air intake manifold to generate a load signal indicative of the detected pressure.

17. The method of claim 14 wherein said at least one fuel delivery device is two groups of fuel injector valves, said method further includes the steps of:

toggling a bi-stable switch with said trigger signals to generate sequence signals alternating in value in timed relationship with trigger signals;

activating gate means disposed between said comparator and said at least two groups of fuel injector valves to energize said two groups of fuel injector valves in an alternating sequence.

18. The method of claim 14 or 17 wherein said first and second storage means are a first and second capacitor respectively, said step of generating a speed reference signal generates at least a first current signal controlling the charging said first capacitor and the value of said first sum signal is the value of the charge stored on said first capacitor, said step of generating a ramp signal generates a second charging current increasing the charge on stored in the second capacitor from the value of the transferred first sum signal to a substantially higher value and the value of the charge on said second capacitor is said second sum signal, and said step of transferring includes the step of transferring the charge on said first capacitor to said second capacitor in response to each transfer signal.

19. The method of claim 18 wherein said step of transferring said first sum signal to said second storage means comprises the steps of:

comparing in response to each transfer signal the value of the charge on said first capacitor with the charge on said second capacitor to generate a discharge signal when the value of the charge on said second capacitor is greater than the value of the charge on said first capacitor; and energizing a discharge circuit with said discharge signal to discharge said second capacitor to the value of the charge on said first capacitor.

20. The method of claim 18 wherein said step of generating a speed reference signal further includes the steps of:

energizing a switch signal generator with said trigger signals to sequentially generate a series of switch signals; and switching in sequence in response to said switch signals a plurality of current sources and current sinks one at a time to vary the value of the charge on said first capacitor as a function of time after each transfer signal.

21. The method of claim 20 wherein said step of generating a ramp signal further includes switching in response to said switch signals between at least two different current sources generating two different currents varying the rate at which said second capacitor is charged to generate said second sum signal.

22. The method of claim 15 wherein said step of transferring said first sum signal to said second storage means comprises the steps of:

comparing in response to each transfer signal the value of the charge on said first capacitor with the charge on said second capacitor to generate a discharge signal when the value of the charge on said second capacitor is greater than the value of the charge on said first capacitor; and energizing a discharge circuit with said discharge signal to discharge said second capacitor to the value of the charge on said first capacitor.

23. The method of claim 15 wherein said step of generating a speed reference signal further includes the steps of:

energizing a switch signal generator with said trigger signals to sequentially generate a series of switch signals; and switching in sequence in response to said switch signals a plurality of current sources and current sinks one at a time to vary the value of the charge on said first capacitor as a function of time after each transfer signal.

24. The method of claim 23 wherein said step of generating a ramp signal further includes switching in response to said switch signals between at least two different current sources generating two different currents varying the rate at which said second capacitor is charged to generate said second sum signal.

* * * * *